US006837308B2

(12) United States Patent
Michel

(10) Patent No.: US 6,837,308 B2
(45) Date of Patent: Jan. 4, 2005

(54) APPARATUS AND METHOD FOR GRAVEL PACKING

(75) Inventor: Donald H. Michel, Lafayette, LA (US)

(73) Assignee: BJ Services Company, Houston, TX (US)

( * ) Notice: Subject to any disclaimer, the term of this patent is extended or adjusted under 35 U.S.C. 154(b) by 54 days.

(21) Appl. No.: 09/927,829

(22) Filed: Aug. 10, 2001

(65) Prior Publication Data

US 2003/0029614 A1 Feb. 13, 2003

(51) Int. Cl.[7] ..... E21B 43/04
(52) U.S. Cl. ..... 166/51; 166/227; 166/278
(58) Field of Search ..... 166/276, 278, 166/51, 227, 230, 231, 233, 235

(56) References Cited

U.S. PATENT DOCUMENTS

| | | | | |
|---|---|---|---|---|
| 4,506,730 A | | 3/1985 | McCollin et al. | 166/85 |
| 4,558,742 A | | 12/1985 | Huang et al. | 166/278 |
| 4,945,991 A | | 8/1990 | Jones | 166/278 |
| 4,964,464 A | | 10/1990 | Myers | 166/278 |
| 5,004,049 A | | 4/1991 | Arterbury | 166/228 |
| 5,082,052 A | | 1/1992 | Jones et al. | 166/51 |
| 5,113,935 A | | 5/1992 | Jones et al. | 166/51 |
| 5,330,003 A | | 7/1994 | Bullick | 166/278 |
| 5,333,688 A | | 8/1994 | Jones et al. | 166/278 |
| 5,341,880 A | | 8/1994 | Thorstensen et al. | 166/278 |
| 5,355,949 A | | 10/1994 | Sparlin et al. | 166/236 |
| 5,394,938 A | | 3/1995 | Cornette et al. | 166/51 |
| 5,419,394 A | | 5/1995 | Jones | 166/51 |
| 5,476,143 A | | 12/1995 | Sparlin et al. | 166/233 |
| 5,505,260 A | | 4/1996 | Andersen et al. | 166/278 |
| 5,515,915 A | | 5/1996 | Jones et al. | 166/51 |
| 5,551,513 A | | 9/1996 | Surles et al. | 166/278 |
| 5,785,122 A | * | 7/1998 | Spray | 166/227 |
| 5,842,516 A | | 12/1998 | Jones | 166/56 |
| 5,868,200 A | | 2/1999 | Bryant et al. | 166/51 |
| 5,890,533 A | | 4/1999 | Jones | 166/51 |
| 5,934,376 A | | 8/1999 | Nguyen et al. | |
| 6,092,604 A | | 7/2000 | Rice et al. | 166/378 |
| 6,227,303 B1 | | 5/2001 | Jones | 166/378 |
| 6,427,775 B1 | | 8/2002 | Dusterhoft et al. | |
| 6,446,722 B2 | | 9/2002 | Nguyen et al. | |
| 2002/0079099 A1 | * | 6/2002 | Hurst et al. | 166/278 |
| 2003/0000700 A1 | * | 1/2003 | Hailey, Jr. | 166/278 |
| 2003/0000701 A1 | * | 1/2003 | Dusterhoft et al. | 166/278 |

FOREIGN PATENT DOCUMENTS

| | | | |
|---|---|---|---|
| EP | 0 527 426 A1 | 8/1992 | E21B/43/08 |

* cited by examiner

*Primary Examiner*—Hoang Dang
(74) *Attorney, Agent, or Firm*—Locke Liddell & Sapp LLP

(57) ABSTRACT

An improved apparatus and method for gravel packing is provided. The apparatus includes a substantially tubular-shaped base pipe having a plurality of apertures disposed along part of its length and a dual-wall sand screen coaxially secured to the base pipe. The dual-wall screen is substantially permeable to fluids and impermeable to sand. The apparatus provides a plurality of fluid permeable channels formed within the sand screen, which are disposed along the entire length of the screen. Each channel has an associated plurality of ports spaced along discrete intervals of the screen, which communicate with an annulus formed between the apparatus and the wellbore. The method provides for injecting a sand and fluid slurry mixture through the screen and out of the ports. This design reduces the incidence of sand bridge formation, and packs gravel around any sand bridges, which may be formed.

13 Claims, 6 Drawing Sheets

APPARATUS AND METHOD FOR GRAVEL PACKING

FIELD OF THE INVENTION

The present invention relates generally to an apparatus and method for gravel packing, and more particularly to an improved apparatus and method, which reduces the incidence of sand bridge formation, which occur prior to the completion of successful gravel packs, and provides successful prepacking between screens while the apparatus is in the well.

BACKGROUND OF THE INVENTION TECHNOLOGY

Many prior art gravel packing methods and devices are incapable of completely packing a well penetrating an unconsolidated or poorly consolidated subterranean oil and gas reservoir. With such methods and devices, the annulus between the sand screen and the casing for in-casing gravel packs or between the screen and the side of the hole for open hole or under-reamed gravel packs are not completely packed. The problem of incomplete packing often occurs as a result of the formation of sand "bridges" in the interval to be packed, which prevents the placement of sufficient sand below the bridge, in the case of top down gravel packing, or above the bridge in the case of bottom up gravel packing.

One prior art method, which seeks to solve the problem of sand bridge formation, can be found in U.S. Pat. No. 4,945,991 issued to Lloyd G. Jones and assigned to Mobil Oil Corporation ("the '991 patent"). This method employs one or more shunt tubes, which are mounted to the exterior of the sand screen. The shunt tubes extend substantially throughout the distance of the annulus to be gravel packed and can be open to fluids at both ends or open at the top and sealed at the bottom. In one embodiment, the shunt tubes are provided with perforations at pre-selected intervals along their length to establish fluid communication between the shunt tubes and the annulus, so that if a sand or gravel bridge is formed, the space blocked by the bridge can be filled. In another embodiment of the invention, the slurry is ejected into the annulus through lateral conduits, which are attached to and spaced along the length of the shunt tubes.

The purported method according to the '991 patent includes the following steps. First, a borehole is formed through the reservoir and lined with a casing. Next, the casing is perforated at preselected intervals to form perforation tunnels adjacent a substantial portion of the reservoir. The sand screen is then placed inside of the casing next to the perforation tunnels. The annulus is formed between the sand screen and the casing. In the next step, a fluid slurry containing gravel is injected through the annulus and shunt tubes so that the fluid portion of the slurry is forced out of the annulus through the perforation tunnels into the reservoir and the gravel portion of the slurry is deposited in the annulus and forced out into the perforation tunnels into the formation. The last step is to terminate the injection of the fluid slurry containing gravel when the annulus is packed with gravel.

The method includes two additional steps, which relate more to how the apparatus is constructed than to how the gravel is packed. In accordance with one of these steps, the shunt tubes are positioned coaxially adjacent to the sand screen such that the shunt tubes extend substantially the length of the sand screen. In accordance with the other step, the cross-sectional area of the shunt tubes and the annulus are sized so that if gravel forms a bridge in a portion of the annulus thereby blocking the flow of fluid slurry through the annulus, the fluid slurry containing gravel will purportedly continue to flow through the shunt tubes and into the annulus around the gravel bridge.

While the method and apparatus disclosed in this prior art reference may help to divert the sand and fluid slurry mixture around any sand bridges, which may be formed, it does not reduce the incidence of sand bridge formation. Furthermore, the apparatus employed in this technique requires the use of additional shunt tubes secured to the outside of the sand screen, which block a portion of the sand screen. This has the disadvantage of blocking a portion of the passageway through which the hydrocarbons being captured is passed to the surface, and therefore reduces the rate, and thus the efficiency, at which hydrocarbons are produced from the reservoir. Another disadvantage of this system is that because the shunt tubes are mounted to the outside of the sand screen they are unprotected and thus susceptible to damage and dislodgment from the sand screen during the installation process. Yet another disadvantage of this configuration is that the external shunt tubes occupy space between the production or base pipe and the well casing or bore. Thus, either the screen base pipe needs to be smaller to accommodate the tubes, which results in less efficient production, or the wellbore has to be larger, which is undesirable.

At least two prior art devices have sought to solve the problem of damage to the shunt tubes. U.S. Pat. No. 5,515,915 issued to Jones et al. and also assigned to Mobil Oil Corporation, sought to solve this problem by placing the shunt tubes between the sand screen and the base pipe. U.S. Pat. No. 5,868,200 issued Bryant et al. and also assigned to Mobil Oil Corporation sought to solve this problem by placing a protective shroud over the shunt tubes. Both of these prior art devices, however, have the same drawbacks as the earlier patent owned by Mobil, namely they do not reduce the incidence of sand bridge formation and they are also not as efficient. The shunt tubes in these devices also block a portion of the passageway through which the hydrocarbons being captured are passed to the surface.

SUMMARY OF THE INVENTION

The present invention overcomes the above-identified problems as well as other shortcomings and deficiencies of existing technologies by providing an apparatus and method for gravel packing, which reduces the incidence of sand bridge formation, without reducing the rate at which hydrocarbons are produced from the reservoir.

In one embodiment of the present invention, an apparatus for gravel packing is provided. The apparatus includes a substantially tubular-shaped base pipe having a plurality of apertures disposed along at least a portion of its length and a dual-wall sand screen coaxially secured to the base pipe. The base pipe is adapted to be disposed within a wellbore and the screen is substantially permeable to fluids and impermeable to sand. The dual-wall sand screen comprises an inner screen jacket and outer screen jacket, which may have one or more sections, and a plurality of support ribs disposed between the inner screen jacket and the outer screen jacket, which define a plurality of channels that deliver the sand and fluid slurry mixture to the wellbore and formation to be packed. The inner screen jacket may be formed of a wire mesh screen or by a helical wire fusion-welded to a plurality of support rods. The outer screen jacket is preferably formed of a helical wire fusion-welded to a plurality of support rods. A pair of end rings are disposed on opposite ends of the apparatus and are secured to the plurality of support ribs and the base pipe. The inner screen jacket is secured directly to the base pipe.

The apparatus further includes at least one diverter ring secured between adjacent sections of the outer screen jacket. The at least one diverter ring has at least one port, which communicates with an annulus formed between the apparatus and the wellbore. The preferred configuration of this embodiment employs at least three diverter rings disposed at discrete intervals along the screen. Each of the diverter rings in this configuration preferably has two ports disposed 180 degrees apart from one another and 60 degrees out of phase from the ports in an adjacent diverter ring. The diverter rings have support members secured to their inside surface, which align with the support ribs secured between the inner and outer screen jackets, and define a portion of the channels used to deliver the sand and fluid slurry mixture to the wellbore and formation to be packed.

In another embodiment of the present invention, the screen has a plurality of ports formed at discrete intervals along its length, which communicate with an annulus formed between the apparatus and the wellbore. The diverter rings are not used in this embodiment. In the preferred configuration of this embodiment, there are at least three intervals of ports formed along the length of the screen with two ports being disposed at each interval 180 degrees apart from one another and 60 degrees out of phase from the ports at adjacent intervals.

In yet another embodiment of the present invention, a method of gravel packing a subterranean formation adjacent an oil and gas reservoir using one the apparatus described above is provided. The method includes the steps of drilling a hole into the subterranean formation thereby forming the wellbore; positioning the apparatus inside of the wellbore adjacent the section of the formation of interest; and injecting a sand and fluid slurry mixture through the screen into an annulus formed between the apparatus and the wellbore until the annulus and dual-wall screen are substantially packed with sand. In certain applications, the steps of forming a casing inside the wellbore and perforating the casing at preselected intervals to form perforation tunnels are also performed prior to insertion of the apparatus into the wellbore.

This apparatus and method has the advantage of not only reducing the incidence of sand bridge formation and packing gravel around any sand bridges that may be formed, but also has the advantage of prepacking the sand screen downhole. Because the prepack of the sand screen is done under pressure, by virtue of the sand and fluid slurry mixture being pumped downhole, a tight prepack is made.

BRIEF DESCRIPTION OF THE DRAWINGS

A more complete understanding of the present disclosure and advantages thereof may be acquired by referring to the following description taken in conjunction with the accompanying drawings wherein.

DETAILED DESCRIPTION OF THE PREFERRED EMBODIMENTS

Figure 1:
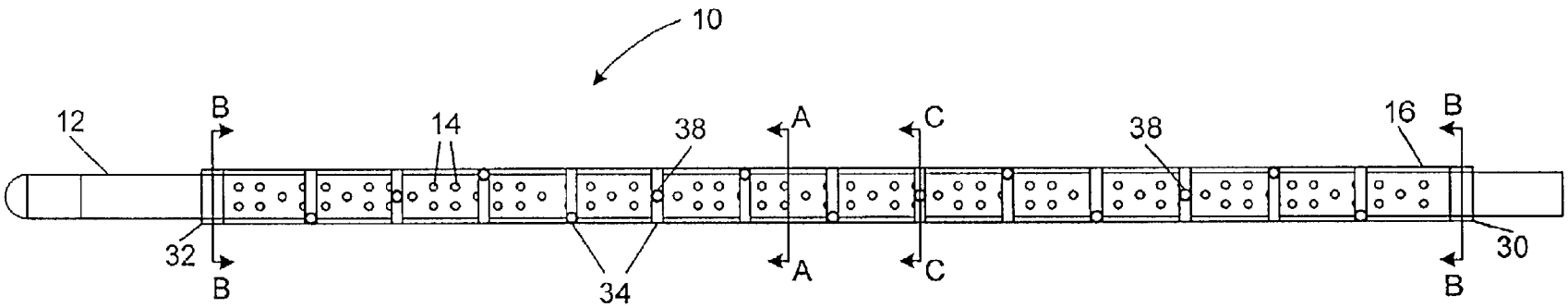
FIG. 1 is a schematic diagram of one embodiment of the apparatus for gravel packing according to the present invention.

Referring now to the drawings, the details of preferred embodiments of the invention are schematically illustrated. FIG. 1 illustrates the apparatus for gravel packing in accordance with the present invention. The apparatus is shown generally by reference numeral 10.

The apparatus 10 includes a base pipe 12, which is also known as a production pipe. The base pipe 12 is preferably formed of a steel alloy. The base pipe 12 has a plurality of apertures 14, which are preferably approximately 0.25–0.50 inches in diameter. The apertures 14 provide a passageway for hydrocarbons to enter into the production pipe 12. The apparatus 10 also includes a dual-wall screen 16, which is provided for blocking gravel and other matter from entering into the production pipe 12.

Figure 2:
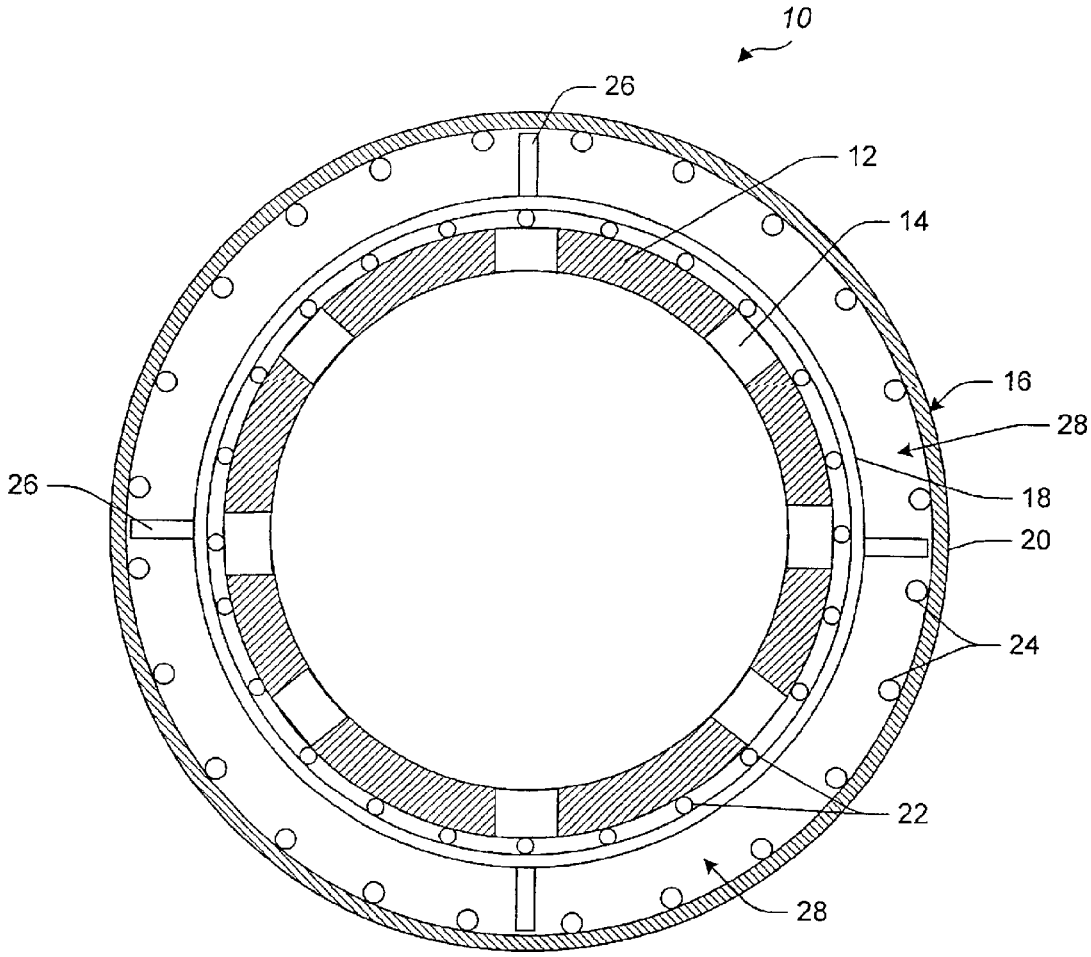
FIG. 2 is a cross-sectional view of the apparatus shown in FIG. 1 taken along line A—A.

The dual-wall screen 16 includes an inner screen jacket 18 and an outer screen jacket 20, as shown in FIG. 2. The inner screen jacket 18 and the outer screen jacket 20 are substantially permeable to fluids and impermeable to sand. In one embodiment, the inner screen jacket 18 is formed by fusion welding a helically-wound steel wire to a plurality of equally-spaced support rods 22. A small gap exists between adjacent windings of the wire (not shown), which is wide enough to allow fluids to pass through but not wide enough to allow gravel pack media to pass through. In another embodiment, the inner screen jacket 18 is formed of a wire mesh screen. The inner screen jacket 18 is welded or attached to the base pipe 12 covering the apertures 14.

The outer screen jacket 20 is preferably formed by fusion welding a helically-wound steel wire to a plurality of equally-spaced support rods 24. A plurality of equally-spaced support ribs 26 are welded to the inside surface of the outer screen jacket 20. The outer screen jacket 20 is fitted over and welded to the inner screen jacket 18. Channels 28 are formed between adjacent support ribs 26 and the inner and outer screen jackets 18 and 20. The channels 28 provide a path for a sand and fluid slurry mixture to flow through the dual-wall screen 16 to an annulus formed between the apparatus 10 and the wellbore and into perforated sections of the formation to be gravel packed.

Figure 3:
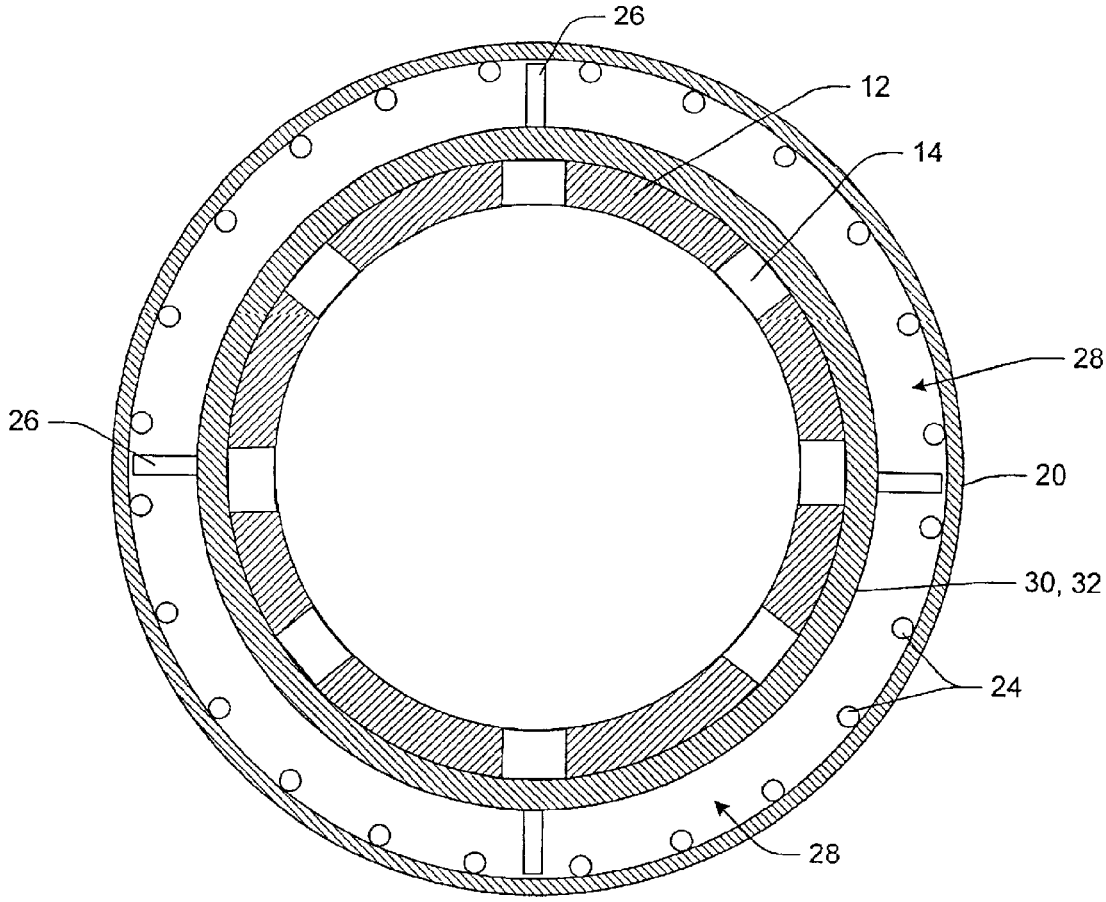
FIG. 3 is a cross-sectional view of the end rings employed in the apparatus shown in FIG. 1 taken along lines B—B.

Two end rings 30 and 32 are disposed at opposite ends of the screen 16, and are welded to the base pipe 12 and the support ribs 26, as shown in FIG. 3. The end rings 30 and 32 are welded directly to the base pipe 12 because the outer screen jacket 20, which is coaxially disposed over the inner screen jacket 18, is longer than the inner screen jacket. With this design, the screen 16 is open at both of its ends, which permits the sand and fluid slurry mixture to flow into and out of the screen freely.

Figure 4:
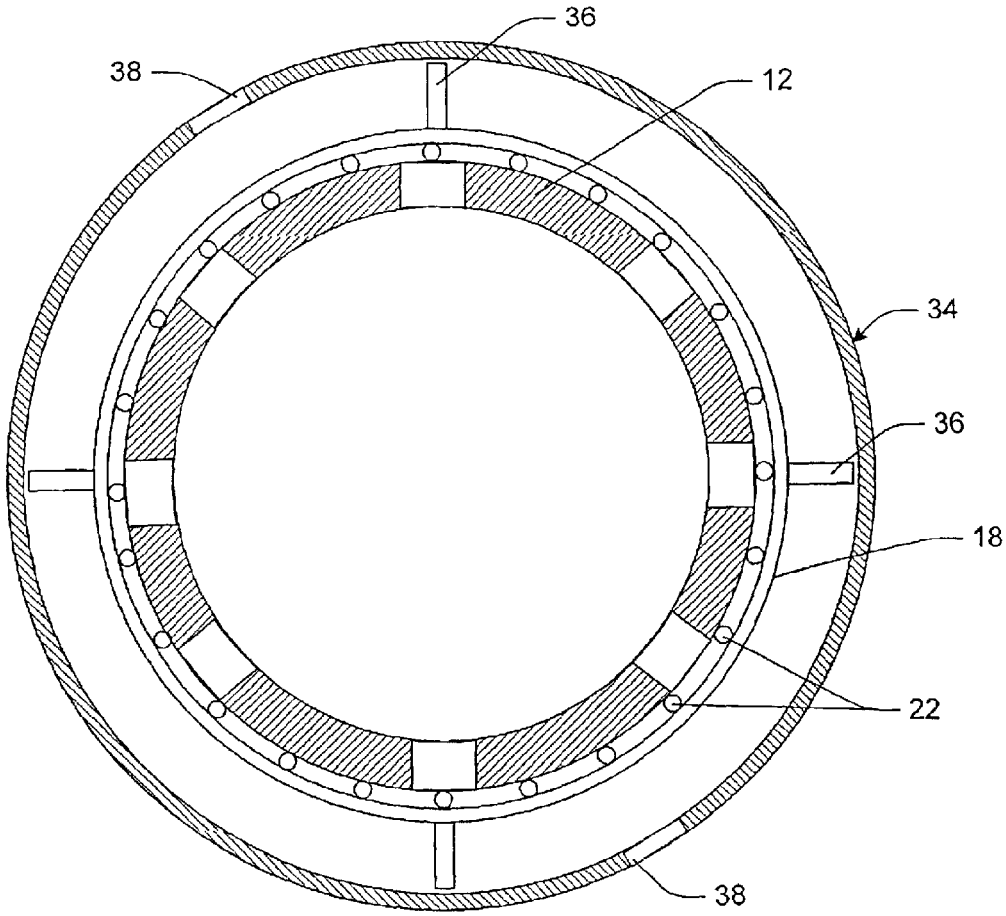
FIG. 4 is a cross-sectional view of a diverter ring employed in the embodiment of the apparatus shown in FIG. 1 taken along line C—C.

In one embodiment of the present invention, the apparatus 10 also includes a plurality of diverter rings 34, as shown in FIG. 1. The diverter rings 34 have a plurality of support members 36 welded to their inside surface, which are equal in number to the support ribs 26, as shown in FIG. 4. The diverter rings 34 slide over the inner screen jacket 18 between adjacent sections of the outer screen jacket 20. The diverter rings 34 are welded to and join adjacent sections of the outer screen jacket 20 and are also secured to the inner screen jacket 18. The support members 36 and support ribs 26 are aligned, so that the channels 28 are linear and uninterrupted throughout the entire length of the screen 16. Each of the diverter rings 34 has a plurality of ports equally spaced around its circumference. In the preferred design, each diverter ring 34 has two exit ports 38 disposed 180 degrees apart from each other, as shown in FIG. 4. Along the sand screen assembly the exit ports of adjacent diverter rings 34 are positioned 60 degrees out of phase from one another, such that every third diverter ring is axially aligned with each other, as shown in FIG. 1. The exit ports 38 on the diverter rings 34 provide a passageway for the sand and fluid slurry mixture to pass from the channels 28 to an annulus formed between the apparatus 10 and the wellbore. Because the exit ports 38 on the diverter rings 34 are disposed at discrete intervals along the sand screen 16, they divert the sand and fluid slurry mixture past any sand bridges that may be formed in the annulus between the wellbore and completion assembly. Furthermore, because the sand screen 16 itself is permeable to fluids, fluid eddies are created along the annulus thereby preventing, or at least substantially minimizing the formation of sand bridges in the first place, as further described below.

Figure 5:
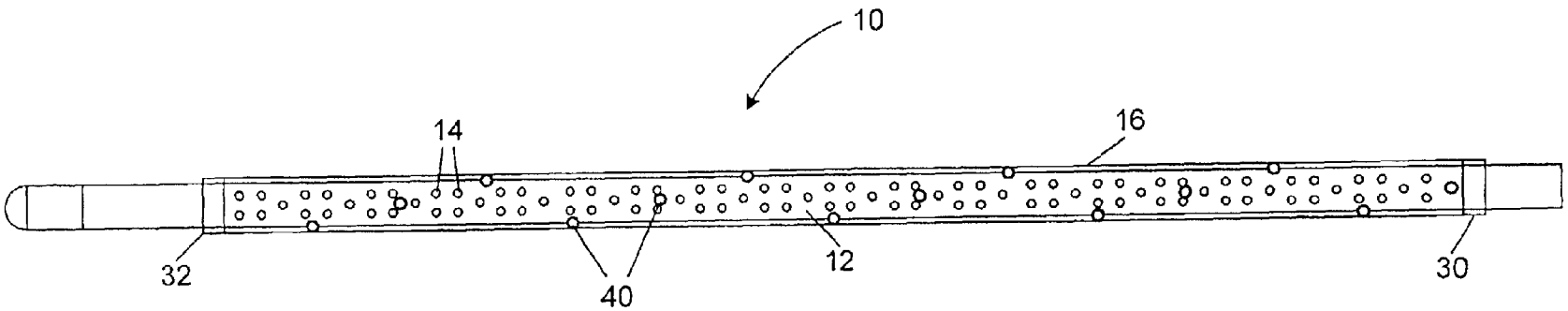
FIG. 5 is a schematic diagram of another embodiment of the apparatus for gravel packing according to the present invention.

In an alternate embodiment, the sand screen 16 is not divided up into sections that are joined by diverter rings 34. Rather, the sand screen 16 is one unit, i.e., it has one inner screen jacket 18 and one outer screen jacket 20. In this alternate embodiment, exit ports 40 are formed in the outer screen jacket 20 in a pattern along the sand screen assembly identical to that formed by the exit ports in the diverter rings, i.e., they are disposed at discrete intervals with two ports per interval each being disposed 180 degrees apart from the other and the pair being 60 degrees out of phase from an adjacent pair of ports. This embodiment is illustrated in FIG. 5. The end rings 30 and 32 are also employed in this alternate configuration and perform the same function as described above with reference to the embodiment shown in FIG. 1.

Figure 6:
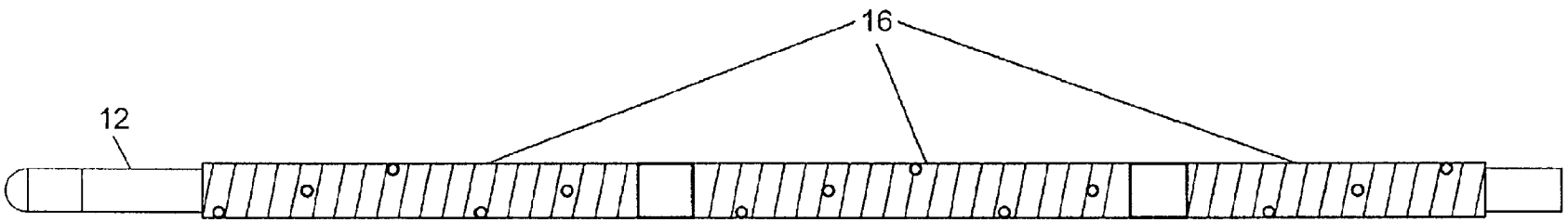
FIG. 6 is a schematic diagram of another aspect of the present invention illustrating the use of multiple sand screens.

In yet another embodiment of the invention, multiple dual-wall screens 16 are employed along a length of the base pipe 12. FIGS. 1 and 5 illustrate different embodiments of a single dual-wall screen 16, however, the invention contemplates that multiple dual wall screens 16 connected end-to-end be employed, as shown in FIG. 6. While only three screens 16 are shown in FIG. 6, that is merely for illustration purposes, it should be recognized by persons of ordinary skill in the art that the optimum number of screens 16 that should be connected together depends upon a number of factors, including the size of the region from which the hydrocarbons will be captured.

The present invention also includes a method of gravel packing that employs the apparatus described above, which will now be described. In the first step, a hole is drilled into the formation adjacent the oil and gas reservoir of interest to form a wellbore. In certain applications, the wellbore is then lined with a casing, which is cemented to the formation. Next, the casing is perforated at preselected intervals to form perforation tunnels adjacent the reservoir. In other applications, the casing step is eliminated, and only the wellbore is formed. In the next step, the apparatus 10 is placed inside of the casing or wellbore adjacent to the producing reservoir. An annulus is formed between the apparatus 10 and the wellbore/casing. Next, the sand and fluid slurry mixture is injected into the annulus and sand screen 16 until the sand and fluid slurry mixture fills the entire annulus and the space formed between the inner and outer screen jackets 20 and 22.

Because the sand screen 16 is permeable to fluids, the fluid portion of the mixture exits the sand screen along its entire length. In high pressure applications, where the fluid exits the screen 16 at a high velocity, it intersects the wall of the wellbore and creates eddies (turbulent flow), which prevent the formation of sand bridges in the annulus. However, in the event that a sand bridge should form in the annulus between sand screen 16 and the wellbore, the void created above the bridge (or below the bridge, as the case may be) is filled by the slurry exiting the ports in the diverter ring(s) 34 disposed adjacent to the void in the embodiment of FIG. 1 (or the ports 40 adjacent the void in the embodiment of FIG. 5). Thus, the apparatus 10 and method of gravel packing according to the present invention provides a system that virtually insures that the entire annulus between the sand screen 16 and the wellbore as well as the entire sand screen itself are completely packed with gravel.

While the present invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

What is claimed is:

1. An apparatus for gravel packing comprising:

(a) a base pipe having a plurality of apertures disposed along at least a portion of its length, said base pipe adapted to be disposed within a wellbore;

(b) a screen coaxially secured to said base pipe adjacent said apertures, said screen being substantially permeable to fluids and impermeable to sand and wherein said screen comprises an inner screen jacket and an outer screen jacket secured thereto; and (c) at least one channel disposed within said screen, which is permeable to fluids along its length, and has at least one port adapted to allow a sand and fluid slurry mixture to pass into or out of said screen.

2. An apparatus for gravel packing according to claim 1, wherein said inner screen jacket is formed by fusion welding a helically-wound steel wire to a plurality of equally-spaced support rods.

3. An apparatus for gravel packing according to claim 1, wherein said inner screen jacket is formed of a wire mesh screen.

4. An apparatus for gravel packing according to claim 1, wherein said outer screen jacket is formed by fusion welding a helically-wound steel wire to a plurality of equally-spaced support rods.

5. An apparatus for gravel packing according to claim 1, comprising a plurality of equally spaced support ribs disposed between the inner screen jacket of the screen and the outer screen jacket of the screen, wherein said at least one channel is formed between a pair of two adjacent support ribs.

6. An apparatus for gravel packing according to claim 5, wherein four support ribs are disposed between the inner screen jacket of the screen and the outer screen jacket of the screen, thereby forming four discrete arc-shaped channels.

7. An apparatus for gravel packing according to claim 5, further comprising a pair of end rings secured at opposite ends of the screen between the base pipe and the plurality of support ribs.

8. An apparatus for gavel packing according to claim 1, wherein the outer screen jacket is formed in multiple sections.

9. An apparatus for gavel packing according to claim 8, further comprising a plurality of diverter rings, wherein each diverter ring is secured over said inner screen jacket and between different adjacent sections of said outer screen jacket, and wherein each diverter ring has at least one port, which communicates with an annulus formed between the apparatus and the wellbore.

10. An apparatus for gravel packing according to claim 9, wherein there are at least three diverter rings, each diverter ring having two ports, which are disposed 180 degrees apart from one another, and wherein the ports on each diverter ring are disposed 60 degrees out of phase from the ports of an adjacent ring.

11. An apparatus for gravel packing according to claim 1, wherein said screen has a plurality of ports formed at discrete intervals along its length, which communicate with an annulus formed between the apparatus and the wellbore.

12. An apparatus for gravel packing according to claim 11, wherein there are at least three intervals of ports formed along the length of said screen.

13. An apparatus for gravel packing according to claim 12, wherein two ports are disposed at each interval 180 degrees apart from one another and 60 degrees out of phase from the ports at adjacent intervals.

* * * * *